US008170447B2

(12) United States Patent
Kubo et al.

(10) Patent No.: US 8,170,447 B2
(45) Date of Patent: May 1, 2012

(54) IMAGE FORMING APPARATUS, DEVELOPING APPARATUS AND CONTACT-RETRACTING METHOD

(75) Inventors: Keisuke Kubo, Ebina (JP); Kei Hirata, Ebina (JP); Tomio Onuki, Ebina (JP); Takeshi Okoshi, Ebina (JP); Toshikazu Tsumita, Ebina (JP); Taiyou Uehara, Ebina (JP); Takashi Sakamoto, Ebina (JP); Naoya Iwata, Hadano (JP); Hirohisa Kohno, Ebina (JP); Akihide Kawamura, Ebina (JP); Kazunori Koshimori, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 947 days.

(21) Appl. No.: 12/020,866

(22) Filed: Jan. 28, 2008

(65) Prior Publication Data

US 2009/0047041 A1 Feb. 19, 2009

(30) Foreign Application Priority Data

Aug. 17, 2007 (JP) ..... 2007-212865

(51) Int. Cl.
*G03G 15/00* (2006.01)

(52) U.S. Cl. ..... 399/118; 399/203; 399/205; 399/228; 399/411

(58) Field of Classification Search ..... 399/222, 399/90, 110, 113, 118, 151–152, 177, 203, 399/205, 228, 234, 411
See application file for complete search history.

(56) References Cited

U.S. PATENT DOCUMENTS

| | | | | |
|---|---|---|---|---|
| 4,792,825 | A * | 12/1988 | Saito et al. | 399/227 |
| 5,008,711 | A * | 4/1991 | Sakamoto et al. | 399/24 |
| 5,512,984 | A * | 4/1996 | Kimura et al. | 399/228 |
| 5,541,722 | A * | 7/1996 | Ikeda et al. | 399/178 |
| 5,608,498 | A * | 3/1997 | Nagase et al. | 399/130 |
| 5,615,002 | A * | 3/1997 | Haneda et al. | 399/227 |
| 5,991,569 | A * | 11/1999 | Sugihara et al. | 399/113 |
| 6,061,535 | A * | 5/2000 | Yokomori et al. | 399/61 |
| 6,760,557 | B2 * | 7/2004 | Nakazato et al. | 399/111 |
| 7,209,681 | B2 * | 4/2007 | Yamada et al. | 399/119 |
| 7,804,511 | B2 * | 9/2010 | Honobe et al. | 347/149 |
| 2001/0012461 | A1 * | 8/2001 | Yano et al. | 399/222 |
| 2005/0008401 | A1 * | 1/2005 | Kawamura et al. | 399/265 |

(Continued)

FOREIGN PATENT DOCUMENTS

JP 63-144370 A 6/1988

(Continued)

OTHER PUBLICATIONS

Translation of Chinese Office Action dated Jul. 9, 2010 for corresponding Chinese application No. 200810006151.2.

(Continued)

*Primary Examiner* — David Gray
*Assistant Examiner* — Geoffrey Evans
(74) *Attorney, Agent, or Firm* — Sughrue Mion, PLLC

(57) ABSTRACT

The image forming apparatus is provided with: an image carrier; an exposure member that exposes the image carrier and forms an electrostatic latent image on the image carrier; a developing member that develops the electrostatic latent image formed on the image carrier; and a contact-retracting unit that rotates the developing member taking a predetermined position as the rotational center, and brings the developing member in contact with or proximity to the image carrier or retracts the developing member from the image carrier.

11 Claims, 14 Drawing Sheets

U.S. PATENT DOCUMENTS

| | | | | |
|---|---|---|---|---|
| 2006/0245785 | A1 | 11/2006 | Kawamura et al. | |
| 2008/0158328 | A1 * | 7/2008 | Tanaka | 347/130 |
| 2009/0052938 | A1 * | 2/2009 | Sameshima et al. | 399/110 |
| 2009/0052960 | A1 * | 2/2009 | Tanaka et al. | 399/358 |

FOREIGN PATENT DOCUMENTS

| | | | |
|---|---|---|---|
| JP | 62-109102 | U | 1/1989 |
| JP | 10-010864 | A | 1/1998 |
| JP | 2001-265096 | A | 9/2001 |
| JP | 2007-010987 | A | 1/2007 |
| JP | 2007-101636 | A | 4/2007 |

OTHER PUBLICATIONS

Japanese Office Action dated Oct. 11, 2011, issued in Japanese Patent Application No. 2007-212865. English translation.

* cited by examiner

DEVELOPING UNIT RETRACTED POSITION

DEVELOPING POSITION

START RETRACTION
12
θ1
HORIZONTAL SURFACE
57

IN THE MIDDLE OF RETRACTION
12
θ2
57

JUST BEFORE RETRACTION FROM PHOTOCONDUCTER DRUM
12
θ3
57

FINISH RETRACTION
12
θ4
57

IMAGE FORMING APPARATUS, DEVELOPING APPARATUS AND CONTACT-RETRACTING METHOD

CROSS REFERENCE TO RELATED APPLICATIONS

This application is based on and claims priority under 35 USC §119 from Japanese Patent Application No. 2007-212865 filed Aug. 17, 2007.

BACKGROUND

1. Technical Field

The present invention relates to an image forming apparatus, a developing apparatus and a contact-retracting method.

2. Related Art

In an image forming apparatus of using an electrophotographic method such as a printer and a copying machine, a photo conductor is exchanged in accordance with the life thereof. In addition, there is a case where a trouble is caused in the photo conductor. In such a case, there is also a need for exchanging. Therefore, in order to make the exchange of the photo conductor easy, in general, the photo conductor, and a function member that is arranged around the photo conductor such as an exposure unit and a developing unit are configured so as to brought in contact with or retract from each other.

In general, when the photo conductor and the developing unit are brought in contact with or retracted from each other, a developer or the like easily drops off from the developing unit. When for example the developer drops off to a light emitting portion of an exposure unit that exposes the photo conductor, the dropping-off is a main cause for generating an image defect.

SUMMARY

According to an aspect of the invention, there is provided an image forming apparatus including: an image carrier; an exposure member that exposes the image carrier and forms an electrostatic latent image on the image carrier; a developing member that develops the electrostatic latent image formed on the image carrier; and a contact-retracting unit that rotates the developing member taking a predetermined position as the rotational center, and brings the developing member in contact with or proximity to the image carrier or retracts the developing member from the image carrier.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described in detail with reference to the attached drawings.

First Exemplary Embodiment

Figure 1:
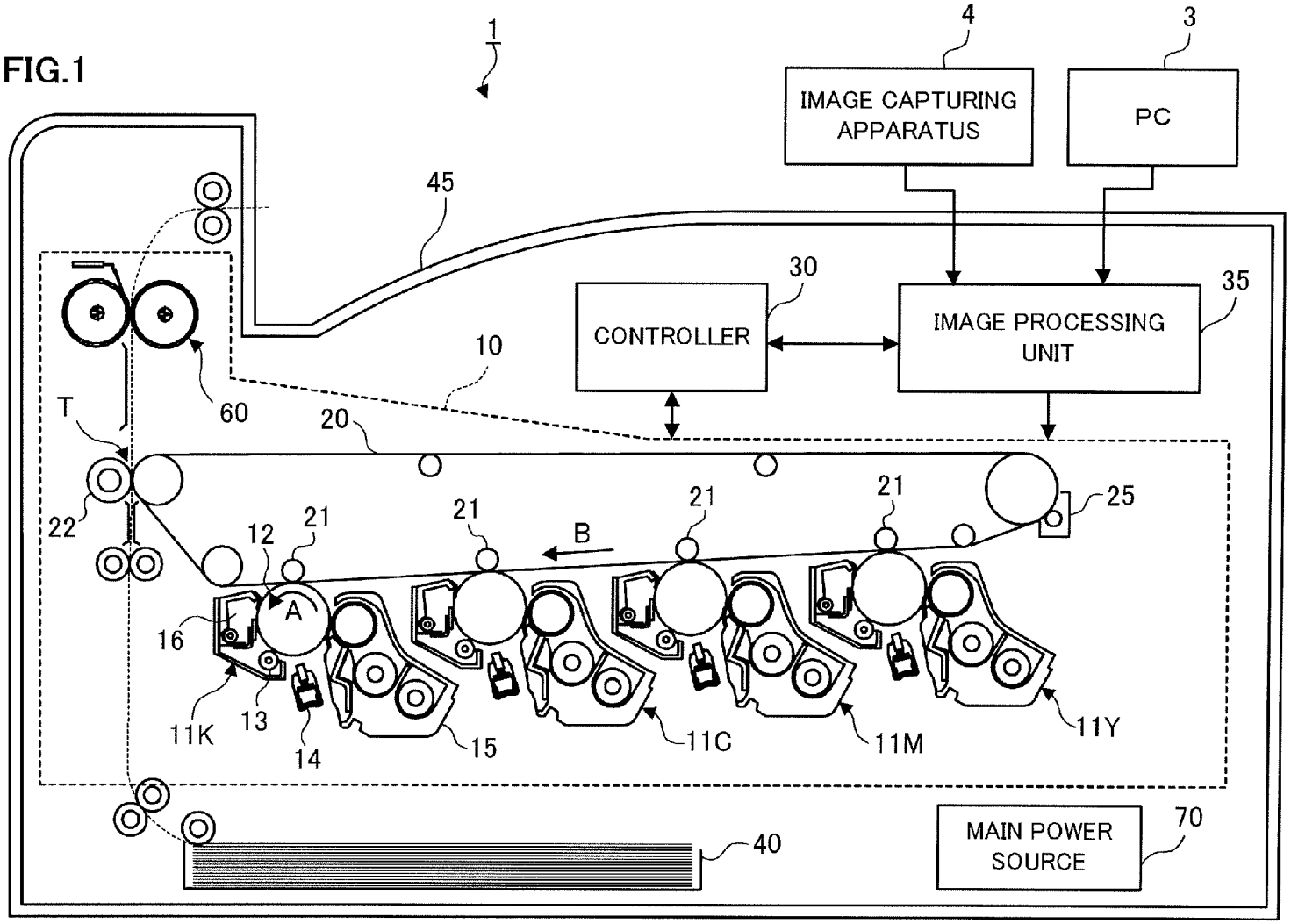
FIG. 1 is a diagram showing an entire configuration example of an image forming apparatus 1 to which the first exemplary embodiment of the present invention is applied.

FIG. 1 is a diagram showing an entire configuration example of an image forming apparatus 1 to which the first exemplary embodiment of the present invention is applied. The image forming apparatus 1 shown in FIG. 1 is what is termed as a tandem-type color printer, and includes an image forming process unit 10, a controller 30, an image processing unit 35 and a main power source 70. Specifically, the image forming process unit 10 forms an image in response to image data of each color. The controller 30 controls the entire operations of the image forming apparatus 1. The image processing unit 35 is connected with external devices such as a personal computer (PC) 3 and an image capturing apparatus 4, and performs certain image processing on image data received from the external devices. The main power source 70 supplies electric power to each unit.

The image forming process unit 10 is provided with four image forming units 11Y, 11M, 11C and 11K (hereinafter, collectively referred to as the "image forming unit 11") that are arranged in parallel at a fixed interval. The each image forming unit 11 is provided with a photoconductor drum 12 serving as an example of an image carrier that forms an electrostatic latent image and retains a toner image, an electrically charging unit 13 that electrically charges a surface of the photoconductor drum 12 uniformly at a predetermined potential, a LED printhead (LPH) 14 serving as an example of an exposure member that exposes the photoconductor drum 12 electrically charged by the electrically charging unit 13 on the basis of image data, a developing unit 15 serving an example of a developing member that develops the electrostatic latent image formed on the photoconductor drum 12, and a cleaner 16 that cleans the surface of the photoconductor drum 12 after transfer.

The each image forming unit 11 is constituted approximately similarly to each other except a toner that is housed in the developing unit 15. The each image forming unit 11 forms toner images of yellow (Y), magenta (M), cyan (C) and black (K) respectively.

Further, the image forming process unit 10 is provided with an intermediate transfer belt 20 in which the toner images of each colors formed in the photoconductor drum 12 of the each image forming unit 11 are overlappedly transferred, a primary transfer roll 21 that successively transfers the toner images of each colors formed by the each image forming unit 11 to the intermediate transfer belt 20 (primary transfer), a secondary transfer roll 22 that collectively transfers the overlapped toner images transferred on the intermediate transfer belt 20 to a paper serving as a recording material (recording paper) (secondary transfer), and a fixing unit 60 that fixes the secondarily transferred image on the paper.

In the each image forming unit 11, the photoconductor drum 12, the electrically charging unit 13 and the cleaner 16 are formed as an integral module (hereinafter, referred to as the "photoconductor module MOD"). The photoconductor module MOD is configured detachably from the image forming apparatus 1, and is exchangeable in accordance with the life of the photoconductor drum 12 or the like. It should be noted that the photoconductor module MOD may be constituted only by the photoconductor drum 12, or by the photoconductor drum 12 and the electrically charging unit 13. That is, as long as the photoconductor module MOD includes the photoconductor drum 12 whose life is shorter than other constituent components, the photoconductor module MOD may be constituted in combination with any other constituent components. However, the photoconductor module MOD according to the first exemplary embodiment is on the premise that the photoconductor module MOD is configured separately from the LPH 14 and the developing unit 15.

The LPH 14 according to the first exemplary embodiment is configured to be permitted contact or retraction between a predetermined position that is set at the time of forming the image to expose the photoconductor drum 12 (hereinafter, also referred to as the "exposure position"), and a position that is set at, for example, the time of attaching and detaching the photoconductor module MOD and retracted from the photoconductor drum 12 (hereinafter, also referred to as the "LPH retracted position" by a contact-retracting mechanism (retracting mechanism) that is described later.

The developing unit 15 according to the first exemplary embodiment is configured so as to be brought in contact with or retracted from the photoconductor drum 12 in accordance with the contact-retracting action of the LPH 14. That is, the developing unit 15 is arranged at a predetermined position that is to develop the electrostatic latent image formed on the photoconductor drum 12 (hereinafter, also referred to as the "developing position") in the case where the LPH 14 is set at the exposure position. In the case where the LPH 14 is set at the LPH retracted position, the developing unit 15 is arranged at a position that is retracted from the photoconductor drum 12 (hereinafter, also referred to as the "developing unit retracted position").

In such an image forming apparatus 1 according to the first exemplary embodiment, an image processing unit 35 performs an image treatment to the image data that is inputted from a PC3 or an image reading apparatus 4. The image data is supplied to the image forming unit 11 through an interface (not shown). Then, for example in the image forming unit 11K of black (K), while the photoconductor drum 12 is rotated in the arrow A direction, the photoconductor drum 12 is uniformly electrically charged by the electrically charging unit 13 at a predetermined potential, and exposed by the LPH 14 that emits light on the basis of the image data sent from the image processing unit 35. Thereby, on the photoconductor drum 12, the electrostatic latent image with regard to the image of black color (K) is formed. The electrostatic latent image that is formed on the photoconductor drum 12 is developed by the developing unit 15, and on the photoconductor drum 12, a toner image of black (K) is formed. In the image forming units 11Y, 11M and 11C, toner images of each color, yellow (Y), magenta (M) and cyan (C) are also formed respectively.

The toner image of each color that is formed in the each image forming unit 11 is successively electrostatically absorbed onto the intermediate transfer belt 20 that is moved in the arrow B direction by the primary transfer roll 21, and hence a composite toner image in which each color toner is superimposed is formed. The composite toner image on the intermediate transfer belt 20 is conveyed to an area where the secondary transfer roll 22 is arranged (secondary transfer unit T) in accordance with movement of the intermediate transfer belt 20. When the composite toner image is conveyed to the secondary transfer unit T, the paper is supplied from a paper holding unit 40 to the secondary transfer unit T in accordance with a timing when the toner image is conveyed to the secondary transfer unit T. Then, by a transfer electric field that is formed in the secondary transfer unit T by the secondary transfer roll 22, the composite toner image is collectively electrostatically transferred onto the conveyed paper.

After that, the paper on which the composite toner image is electrostatically transferred is detached from the intermediate transfer belt 20 and conveyed to the fixing unit 60. The composite toner image on the paper that is conveyed to the fixing unit 60 is fixed onto the paper by receiving a fixing treatment with heat and pressure by the fixing unit 60. Then, the paper in which the fixed image is formed is conveyed to a discharged paper loading unit 45 that is provided in a discharging portion of the image forming apparatus 1.

Meanwhile, a toner that is put on the intermediate transfer belt 20 after the secondary transfer (remaining transfer toner) is removed from a surface of the intermediate transfer belt 20 by a belt cleaner 25 after completion of the secondary transfer, and prepared for the following image forming cycle.

In such a way, a cycle of image formation in the image forming apparatus 1 is repeatedly performed for the number of paper to be printed.

Figure 2:
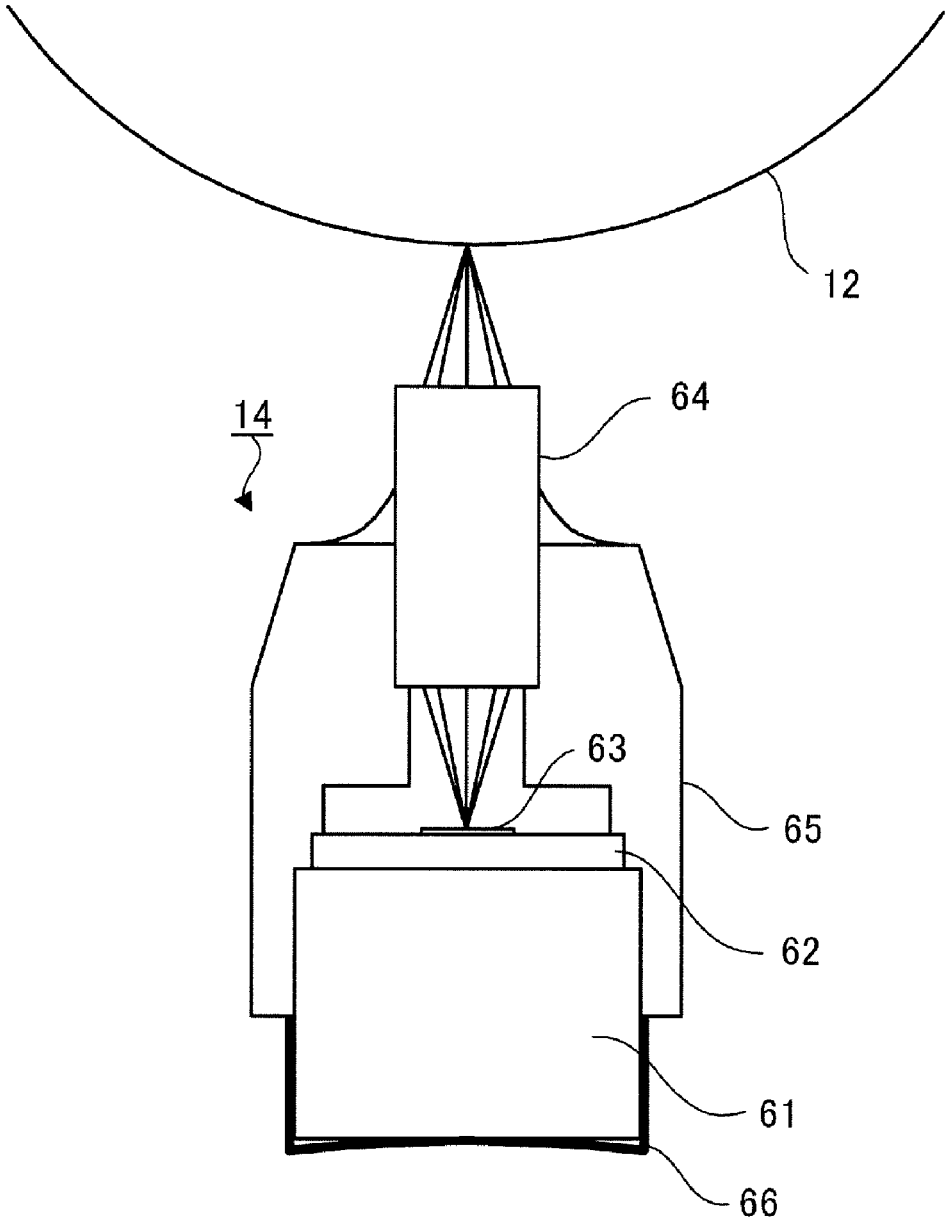
FIG. 2 is a sectional configuration diagram that shows the configuration of the LPH.

Next, a description is given to a configuration of the LED printhead (LPH) 14 serving as an exposure apparatus. FIG. 2 is a sectional configuration diagram that shows the configuration of the LPH 14. The LPH 14 according to the first exemplary embodiment is arranged on the lower side of the photoconductor drum 12 to expose the photoconductor drum 12 from the lower side. As shown in FIG. 2, the LPH 14 is provided with a housing 61 serving as a supporting body, LED array 63 serving as a light source, a LED circuit substrate 62 that implements the LED array 63, a drive circuit 100 that drives the LED array 63 (refer to FIG. 3 below) and the like, rod lens array 64 that forms light from the LED array 63 into an image on the surface of the photoconductor drum 12, a holder 65 that supports the rod lens array 64 and shields the LED array 63 from the exterior, and a plate spring 66 that pressurizes the housing 61 in the rod lens array 64 direction.

The housing 61 is formed of a metallic block or sheet such as aluminum and SUS to support the LED circuit substrate 62. The holder 65 is set to support the housing 61 and the rod lens array 64 so that a luminous point of the LED array 63 and a focal point surface of the rod lens array 64 correspond to each other. Further, the holder 65 is configured so as to seal the LED array 63. Thereby, a configuration that dirt from the exterior is not easily put on the LED array 63 is realized. Meanwhile, the plate spring 66 pressurizes the LED circuit substrate 62 in the rod lens array 64 direction through the housing 61 so as to retain a positional relationship between the LED array 63 and the rod lens array 64.

The LPH 14 that is configured as mentioned above is configured movably in the optical axis direction of the rod lens array 64 by an adjusting screw (not shown) and adjusted so that an image forming position (focal point surface) of the rod lens array 64 is located on the surface of the photoconductor drum 12.

Figure 3:
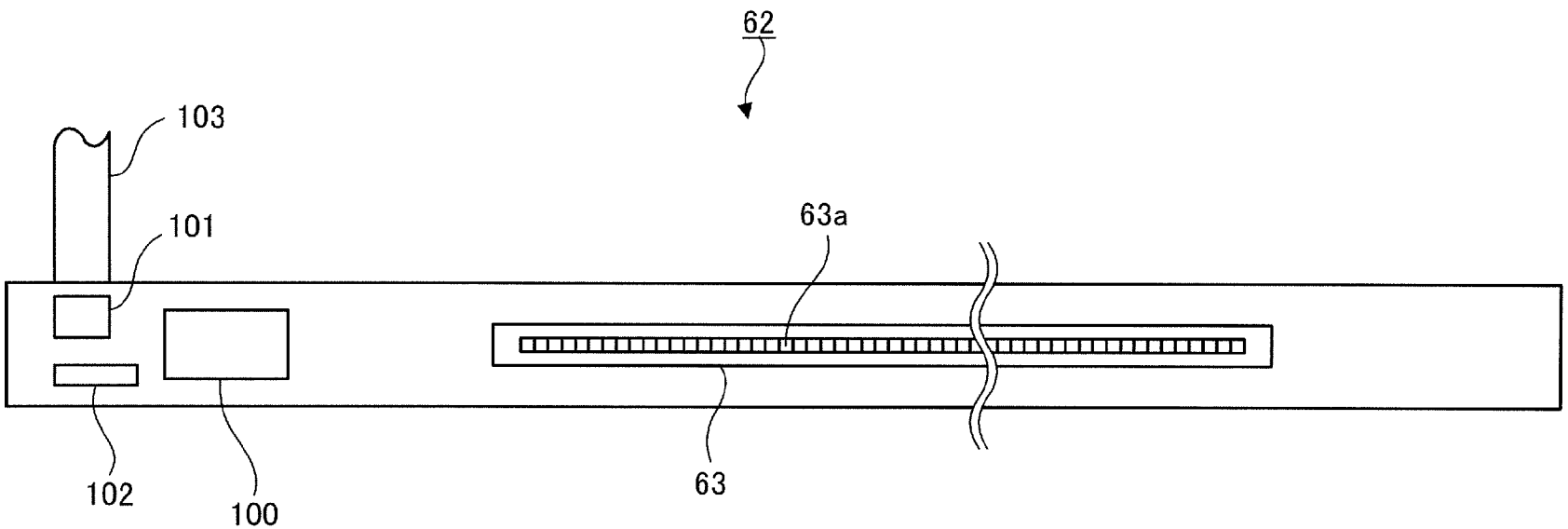
FIG. 3 is a plain view of the LED circuit substrate.

FIG. 3 is a plain view of the LED circuit substrate 62. As shown in FIG. 3, in the LED circuit substrate 62, the LED array 63 including 14,850 LED chips 63*a* for example is arranged in a line shape in parallel with the axial direction of the photoconductor drum 12. Further, in the LED circuit substrate 62, the drive circuit 100 that drives the LED array 63, a three-terminal regulator 101 that outputs a predetermined voltage, a EEPROM 102 that stores correction data of a light amount for the each LED chip 63*a* or the like, and a harness 103 that is to send and receive a signal between a controller 30 and the image processing unit 35, and to receive electric supply from the main power source 70 are arranged. By a drive signal from the drive circuit 100, the each LED chip 63*a* emits light in accordance with the image data, and the light is emitted on the surface of the photoconductor drum 12 from the rod lens array 64.

As mentioned above, the image forming apparatus 1 according to the first exemplary embodiment adopts the configuration that the LPH 14 is arranged on the lower side of the photoconductor drum 12. Therefore, a light emitting surface of the rod lens array 64 faces the upper side. The light emitting surface of the rod lens array 64 is located on the lower side than a position where the developing unit 15 opposes to the photoconductor drum 12.

Figure 4:
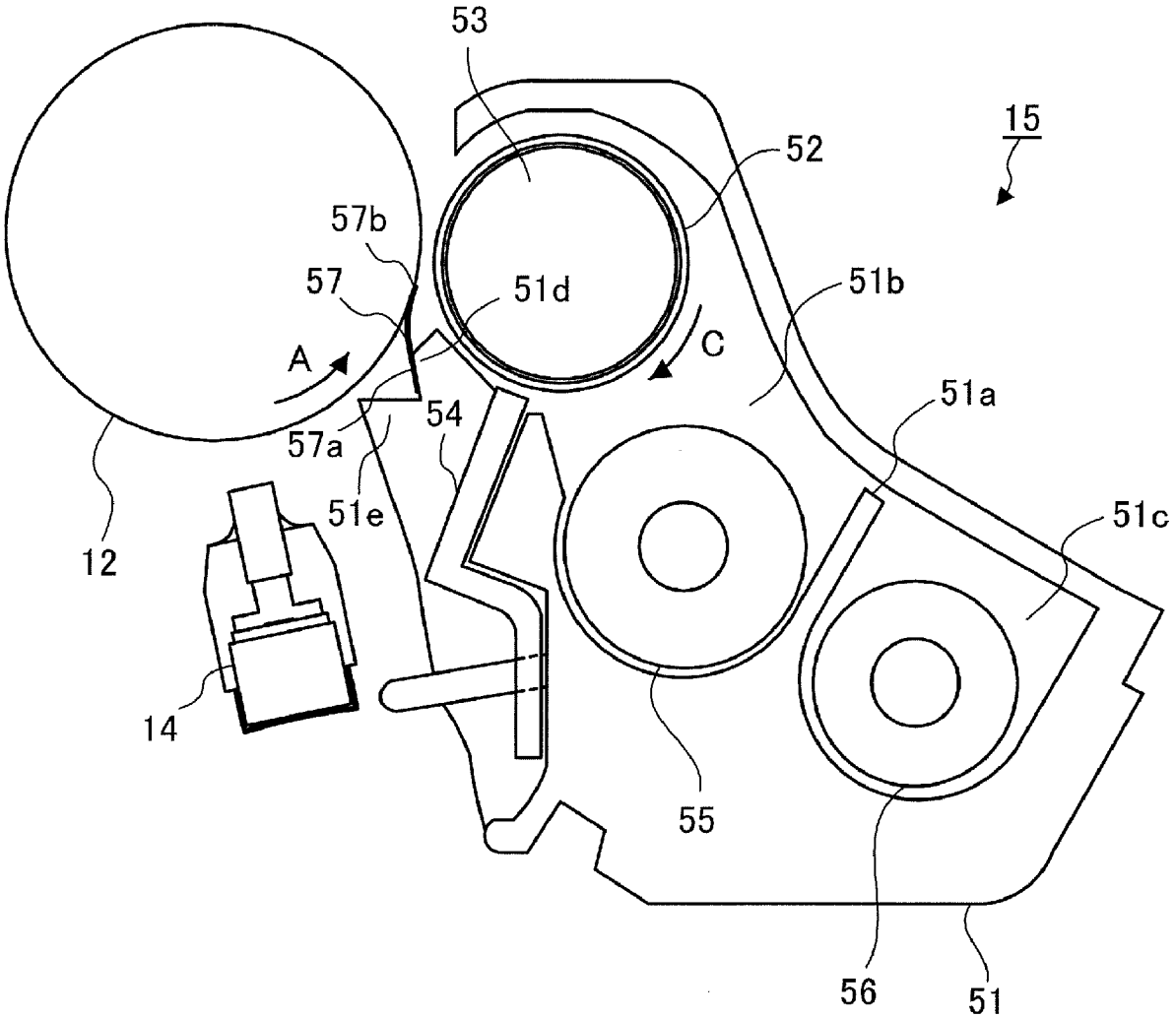
FIG. 4 is a sectional configuration diagram that shows the configuration of the developing unit.

Successively, a description is given to a configuration of the developing unit 15. FIG. 4 is a sectional configuration diagram that shows the configuration of the developing unit 15. As shown in FIG. 4, the developing unit 15 is provided with a supporting container 51 serving as an example of a developer holding container that houses a developer and a casing of the developing unit 15, a developing sleeve 52 serving as an example of a developer holding member, a developing magnet 53 that absorbs the developer to the developing sleeve 52, a blade 54 that regulates a layer thickness of the developer (a coating amount), a developer supplying screw member 55 and a developer agitating screw member 56 that cyclically move the developer in the longitudinal direction of the developing unit 15 while agitating.

The supporting container 51 has an opening towards the photoconductor drum 12 side, and inside thereof, a developer housing unit that houses the developer made by mixing the toner and a carrier that is a magnetic particle is provided. The developer housing unit is divided into a first developer housing unit 51*b* and a second developer housing unit 51*c* by a housing unit wall 51*a* that is provided in the longitudinal direction of the developing unit 15. In the first developer housing unit 51*b*, the developer supplying screw member 55 is arranged, and in the second developer housing unit 51*c*, the developer agitating screw member 56 is arranged. The housing unit wall 51*a* is not provided both end portions in the longitudinal direction of the developing unit 15. The first developer housing unit 51*b* and the second developer housing unit 51*c* are linked up with each other in the both end portions, and the developer is mutually communicating.

The developing sleeve 52 is formed of a non-magnetic material such as aluminum and SUS, and rotated in the arrow C direction by a driving unit (not shown in the figure). To the developing sleeve 52, developing bias generated by direct voltage from a power source (not shown) or developing bias that direct voltage is superimposed on alternating voltage is applied so that a developing electric field is formed between the developing sleeve 52 and the photoconductor drum 12.

Inside the developing sleeve 52, the developing magnet 53 is housed. After the developing sleeve 52 absorbs the developer within the first developer housing unit 51*b* by a magnetic force of the developing magnet 53, the blade 54 regulates the layer thickness of the developer (coating amount). Following rotation of the developing sleeve 52, the developer is conveyed to a position opposing to the photoconductor drum 12 and brought in contact with the photoconductor drum 12 under the developing electric field so that the electrostatic latent image on the photoconductor drum 12 is developed. The developer after developing is conveyed to the inside of the supporting container 51, and recovered to the inside of the first developer housing unit 51*b*.

The blade 54 is formed of a non-magnetic material or a magnetic material to regulate the layer thickness of the developer that is held by the developing sleeve 52 to a predetermined amount with a magnetic pole within the developing magnet 53. Thereby, a predetermined amount of the developer is supplied to the photoconductor drum 12 uniformly over the axial direction of the developing sleeve 52.

Both the developer supplying screw member 55 of the first developer housing unit 51*b* and the developer agitating screw member 56 of the second developer housing unit 51*c* have a structure that a spiral screw is provided around a rotational axis. The developer supplying screw member 55 and the developer agitating screw member 56 are rotated in the opposite direction to each other by the driving unit (not shown in the figure), and convey the toner and the carrier to the opposite direction to each other while agitating. Meanwhile, the first developer housing unit 51*b* and the second developer housing unit 51*c* are linked up with each other in the both end portions of the developing unit 15. Therefore, the developer is circulated between the first developer housing unit 51*b* and the second developer housing unit 51*c* by the developer supplying screw member 55 and the developer agitating screw member 56. Thereby, the developer that is removed from the developing sleeve 52 and recovered to the first developer housing unit 51*b* is conveyed to the second developer housing unit 51*c* by the developer supplying screw member 55 and the developer agitating screw member 56.

To the supporting container 51, a toner supply route (not shown) that supplies the toner to the second developer housing unit 51*c* is connected. The toner supply route is linked up to a toner container (not shown) that is arranged on an upper part of the developing unit 15. By dropping the toner from the toner container in which the toner of each color is stored through the toner supply route, the toner of each color is supplied to the second developer housing unit 51*c* of the each developing unit 15.

When the toner is newly supplied from the toner container to the developer within the second developer housing unit 51*c*, a toner concentration detection sensor (not shown) adjusts a supply amount of toner so as to control the toner concentration within a predetermined range. In the developer in which the toner is newly supplied, the toner and the magnetic carrier are sufficiently agitated and mixed by the developer agitating screw member 56. By the circulation between the first developer housing unit 51*b* and the second developer housing unit 51*c* by the developer supplying screw member 55 and the developer agitating screw member 56, the developer is conveyed to the first developer housing unit 51*b* again. From the first developer housing unit 51*b*, the toner concentration is adjusted within a predetermined range, and the developer in which the toner is sufficiently electrically charged is supplied to the developing sleeve 52. In such a way, the circulation of the developer is performed.

Further, the developing unit 15 according to the first exemplary embodiment is provided with a sealing member 57 serving as an example of a shielding member at a position opposing to the photoconductor drum 12, and in a supporting container side wall 51*d* on the lower side of the developing sleeve 52.

The sealing member 57 is, as shown in FIG. 4, arranged so that one end portion 57*a* is fixed to the supporting container side wall 51*d*, and the other end portion 57*b* faces the downstream side of the rotational direction A of the photoconductor drum 12. The end portion 57*b* is configured so as to be brought in contact with the surface of the photoconductor drum 12.

Thereby, in a state where the developing unit 15 is set at the developing position, the sealing member 57 shields a gap between the developing sleeve 52 and the LPH 14 along the axial direction of the photoconductor drum 12. The sealing member 57 prevents the developer that scatters or drops from the developing sleeve 52 from adhering to the light emitting surface of the rod lens array 64 of the LPH 14 that is arranged on the lower side than the developing sleeve 52. Therefore, the dirt is hardly generated on the light emitting surface of the rod lens array 64.

As the sealing member 57 here, a material in a film shape that hardly generates abrasion, damage or the like on the surface of the photoconductor drum 12 and is in close contact with the surface of the photoconductor drum 12 easily and uniformly such as a polyurethane film is used. Thickness, size and the like of the sealing member 57 are properly selected from the above point of view.

The supporting container 51 on the lower side of the sealing member 57 is provided with a protruding unit 51*e* that protrudes to the photoconductor drum 12 side. For example in the case where the toner or the like that is put on a front end portion of the sealing member 57 (an area on the end portion 57*b* side) spills down, the protruding unit 51*e* prevents the spilled toner or the like from dropping off in the LPH 14 direction.

In such a case, from a view of certainty or the like of catching the toner or the like, it is preferable that a front end position of the protruding unit 51*e* (front end portion that is located at the closest position on the photoconductor drum 12 side) is, during an contact-retracting action of the developing unit 15, located on a plane connecting the sealing member 57 and the light emitting surface of the rod lens array 64, or on a position that is closer to the photoconductor drum 12 side than the plane. From a view of simplifying cleaning or the like, it is preferable that the protruding unit 51*e* is configured detachably from the supporting container 51 or the blade 54.

Next, a description is given to the contact-retracting action of the developing unit 15 according to the first exemplary embodiment.

As mentioned above, for example, in the case where the photoconductor module MOD is attached and detached or the like, the developing unit 15 is brought in contact with or retracted from the photoconductor drum 12 in accordance with a contact-retracting action of the LPH 14. That is, in the case where the photoconductor module MOD is arranged within the image forming apparatus 1 and is set so as to perform the action of forming the image, the LPH 14 is arranged at the exposure position, and corresponding to the position, the developing unit 15 is arranged in the developing position that is to develop the electrostatic latent image of the photoconductor drum 12. For example in the case where the photoconductor module MOD is detached from the image forming apparatus 1, the LPH 14 is moved to the LPH retracted position, and corresponding to the position, the developing unit 15 is moved to the developing unit retracted position that is retracted from the photoconductor drum 12.

The contact-retracting action of the developing unit 15 according to the first exemplary embodiment is performed by a rotation action taking, as the rotational center, a predetermined position that is on the lower side of the sealing member 57 and on the opposite side to the LPH 14 relative to the sealing member 57.

Figure 5B:
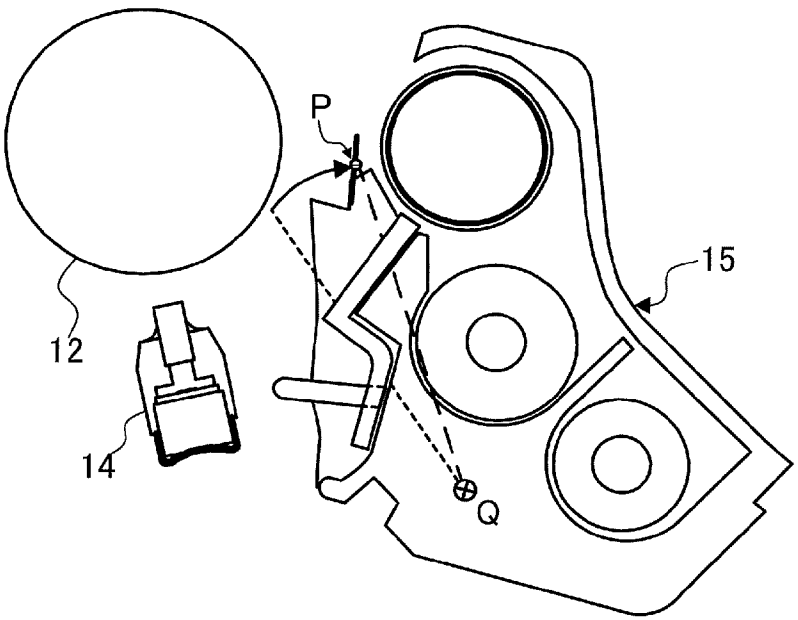
FIGS. 5A and 5B are views that explain the contact-retracting action of the developing unit.
Figure 5A:
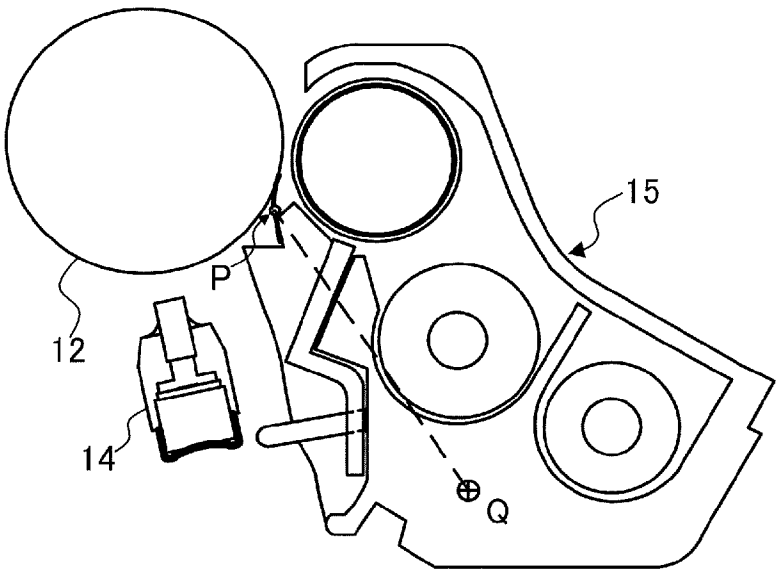

FIGS. 5A and 5B are views that explain the contact-retracting action of the developing unit 15. FIG. 5A shows a state where the developing unit 15 is arranged at the developing position, and FIG. 5B shows a state where the developing unit 15 is moved to the developing unit retracted position. As shown in FIGS. 5A and 5B, in the developing unit 15, the contact-retracting action from the photoconductor drum 12 is performed by the rotation action taking a position Q as the rotational center. The position Q is on the lower side of the sealing member 57 and on the opposite side to the LPH 14 relative to the sealing member 57.

Here, an arbitrary position P within the sealing member 57 that is provided in, for example, the developing unit 15, is focused. In the case where the developing unit 15 is moved from the developing position in FIG. 5A to the developing unit retracted position in FIG. 5B, the position P within the sealing member 57 is moved while drawing an arc taking the position Q as a center. The arc in such a case takes, as the center, the position Q that is on the lower side of the sealing member 57 and on the opposite side to the LPH 14 relative to the sealing member 57. Therefore, the position P is moved on the arc that is located in the second quadrant taking the position Q as an original point within FIG. 5. In the case where the developing unit 15 is moved from the developing position to the developing unit retracted position, the position P is moved in the clockwise direction (in the arrow direction in the figure) on the arc. That is, in the case where the developing unit 15 is moved to the developing unit retracted position, each positions within the sealing member 57 are moved obliquely upward along the arc that is located in the second quadrant. Thereby, as mentioned below, during the contact-retracting action of the developing unit 15, the dropping-off of the toner and the carrier that are put on the sealing member 57 to the LPH 14 side is suppressed.

Figures 6A, 6B, 6C, 6D:
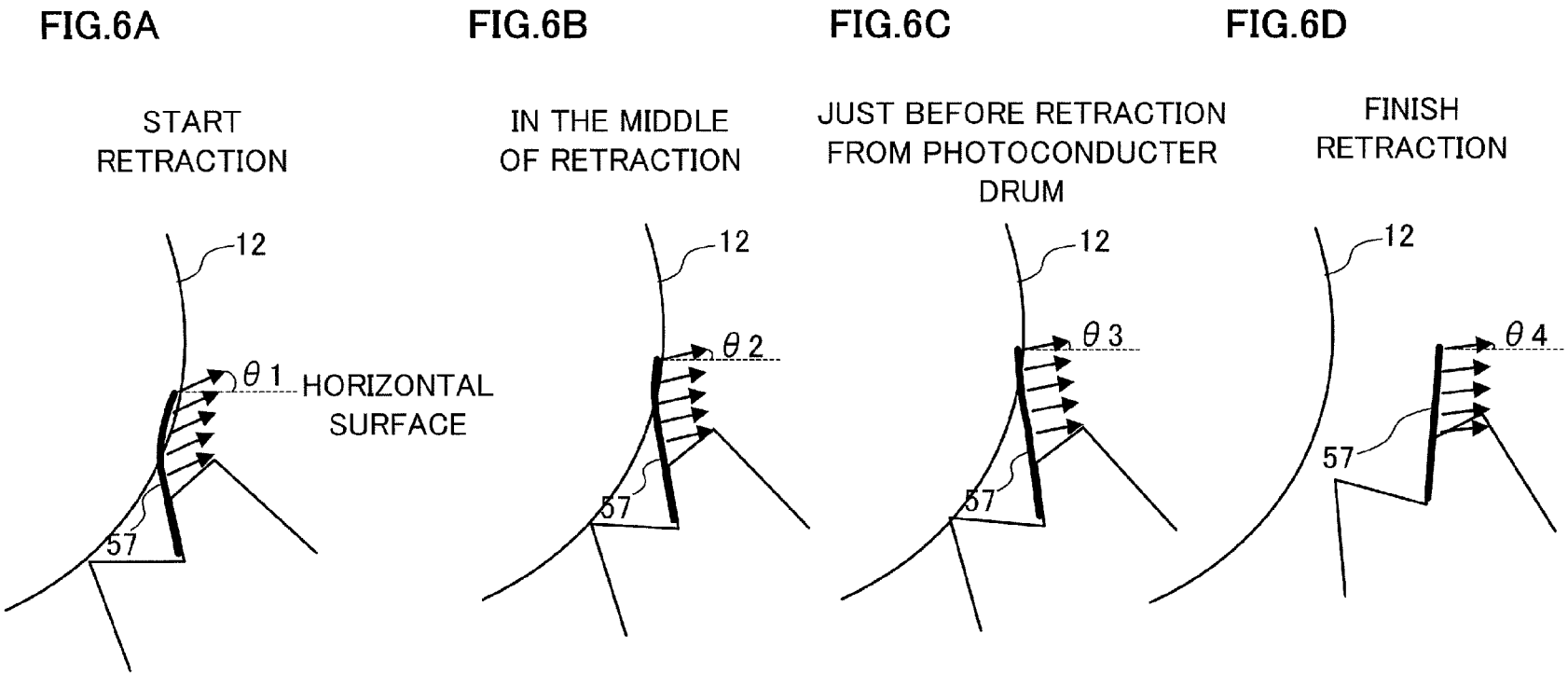
FIGS. 6A to 6D are views that show the moving directions of each of the positions within the sealing member when the developing unit is retracted from the developing position to the developing unit retracted position.

FIGS. 6A to 6D are views that show the moving directions of each of the positions within the sealing member 57 when the developing unit 15 is retracted from the developing position to the developing unit retracted position. FIG. 6A shows a state where the developing unit 15 starts retracting from the developing position, FIG. 6B shows a state where the developing unit 15 is in the middle of retracting, FIG. 6C shows a state that is just before the sealing member 57 is retracted from the photoconductor drum 12, and FIG. 6D shows a state where the developing unit 15 finishes retracting to the developing unit retracted position. In FIGS. 6A to 6D, the moving directions of each of the positions within the sealing member 57 are represented by an angle with a horizontal surface (broken line in the figure). The moving direction in FIG. 6A is θ1, the moving direction in FIG. 6B is θ2, the moving direction in FIG. 6C is θ3, and the moving direction in FIG. 6D is θ4.

When the developing unit 15 is in the middle of moving from the developing position to the developing unit retracted position, deflection generated in the sealing member 57 is gradually released, while the original shape of the sealing member 57 is restored. However, as mentioned above, since the sealing member 57 is moved obliquely upward along the arc that is located in the second quadrant, the moving directions are represented as $\theta 1>\theta 2>\theta 3>\theta 4>0$. Therefore, when the deflection of the sealing member 57 is gradually released, the moving direction of each of the positions within the sealing member 57 is changed to $\theta 1$, $\theta 2$, $\theta 3$ and $\theta 4$ ($\theta 1>\theta 2>\theta 3>\theta 4$) in order. Consequently, the sealing member 57 is retracted from the photoconductor drum 12 from the lower side of the photoconductor drum 12 (the upstream side in the rotational direction) in order.

Thereby, when the sealing member 57 is retracted from the photoconductor drum 12 immediately after the state of FIG. 6C, a backlash due to immediate release of the deflection of the sealing member 57 is extremely small. As a result, when the sealing member 57 is retracted from the photoconductor drum 12, the dropping-off of the toner and the carrier that are put on the sealing member 57 is reduced.

In addition, the deflection of the sealing member 57 is released in the state of FIG. 6C. After the original shape of the sealing member 57 is restored, the sealing member 57 is also moved while sustaining the moving direction of obliquely upward along the arc ($\theta 3$ to $\theta 4$). With the movement, by the contact-retracting action of the entire developing unit 15 along the arc, the sealing member 57 is inclined to the side of the direction retracting from the LPH 14. Thereby, even when the dropping-off of the toner and the carrier that are put on the sealing member 57 is generated, the dropping-off is generated in the inside direction of the developing unit 15. Therefore, the dropping-off of the toner and the carrier to the LPH 14 side is reduced.

In such a case, a horizontal moving amount by the contact-retracting action of the developing unit 15 is set larger than a horizontal moving amount by the contact-retracting action of the LPH 14. Thereby, even when the dropping-off of the toner and the carrier that are put on the sealing member 57 is generated, the dropping-off to the LPH 14 side is reduced.

Further, after the sealing member 57 reaches a position that is sufficiently retracted from the LPH 14, that is, a position that the toner and the carrier do not drop off to the LPH 14 even when the dropping-off of the toner and the carrier is generated, the rotation action taking the position Q as the rotational center may be changed to an action of moving in the horizontal direction.

As mentioned above, in the developing unit 15 according to the first exemplary embodiment, the contact-retracting action is performed by the rotation action taking, as the rotational center, the predetermined position Q that is on the lower side of the sealing member 57 and on the opposite side to the LPH 14 relative to the sealing member 57. Thereby, the dropping-off of the toner and the carrier that are put on the sealing member 57 to the LPH 14 side is reduced.

Next, a description is given to a specific configuration for performing the contact-retracting action (retracting action) of the developing unit 15 mentioned above.

Figure 7:
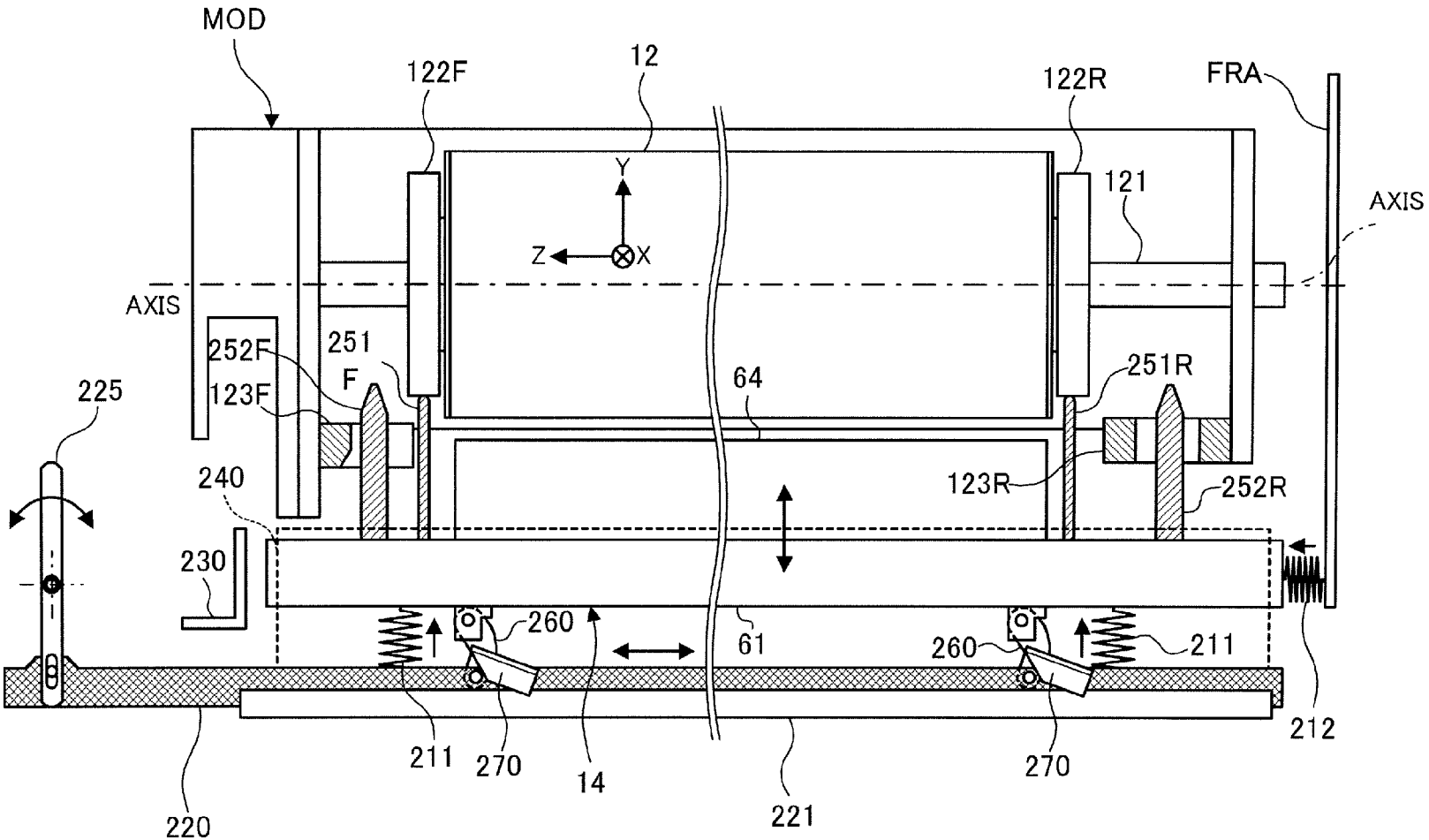
FIG. 7 is a view that shows a state where the LPH is set at the exposure position.
Figure 8:
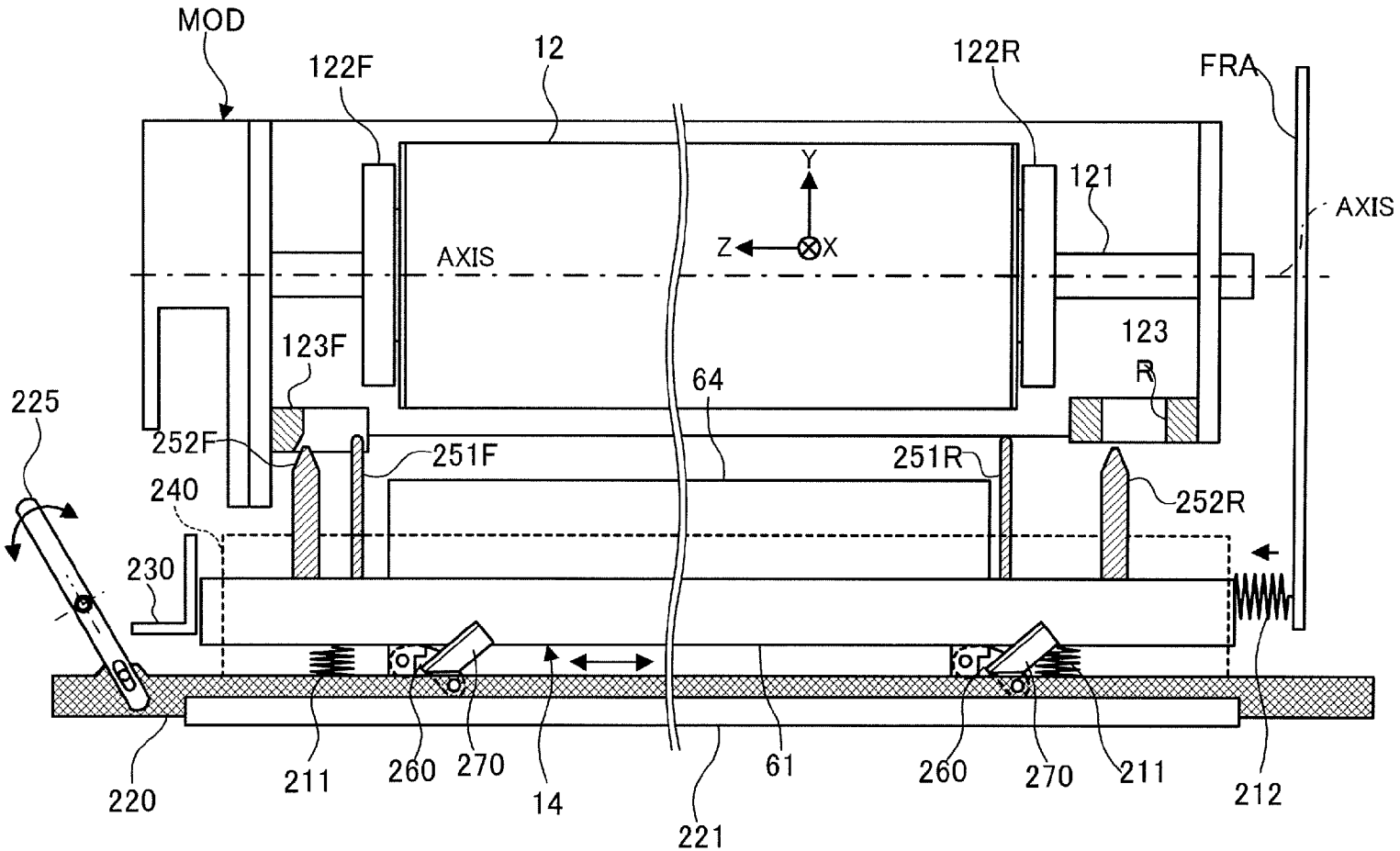
FIG. 8 is a view that shows a state where the LPH is set at the LPH retracted position.

The contact-retracting action (retracting action) of the developing unit 15 according to the first exemplary embodiment is performed linking with the contact-retracting action of the LPH 14. FIG. 7 is a view that shows a state where the LPH 14 is set at the exposure position. FIG. 8 is a view that shows a state where the LPH 14 is set at the LPH retracted position.

In the state where the LPH 14 is set at the exposure position shown in FIG. 7, positioning to set the LPH 14 at a predetermined position relative to the photoconductor drum 12 is performed. It should be noted that in FIGS. 7 and 8, the left side of the figure is the front side of the image forming apparatus 1, that is, the side where the photoconductor module MOD is attached and detached. The right side of the figure is the rear side of the image forming apparatus 1, that is, the side where drive by a drive motor that is rotationally driven is transmitted to the photoconductor drum 12 and the like. It should be noted that in the present specification, with regard to members that have a similar function, the reference numerals for members that are arranged on the front side are added "F" at the end, and the reference numerals for members that are arranged on the rear side are added "R" at the end.

As shown in FIG. 7, in the housing 61 of the LPH 14 according to the first exemplary embodiment, as a positioning mechanism for the LPH 14, first protruding members 251F and 251R that determine a position of the rod lens array 64 in the optical axis direction in the LPH 14 (defined as the "Y direction"), and second protruding members 252F and 252R that determine a position of the photoconductor drum 12 in the axial direction in the LPH 14 (defined as the "Z" direction) and a position in the direction orthogonal to both the Y direction and the Z direction (defined as the "X" direction) at the same time are arranged.

Meanwhile, in the photoconductor module MOD that supports the photoconductor drum 12 according to the first exemplary embodiment, as the positioning mechanism for the LPH 14, Y direction supporting members 122F and 122R that set a position in the Y direction of the LPH 14 by striking the first protruding members 251F and 251R on the LPH 14 side in the same axis as a rotational axis 121 of the photoconductor drum 12, and XZ direction supporting members 123F and 123R that set positions in the X direction and the Z direction of the LPH 14 at the same time by supporting the second protruding members 252F and 252R on the LPH 14 side are arranged.

When the image forming apparatus 1 performs the action of forming the image, in the state where the LPH 14 is set at the exposure position in FIG. 7, the first protruding members 251F and 251R on the LPH 14 side strike the Y direction supporting members 122F and 122R respectively. Thereby, the position in the Y direction of the LPH 14 is set. The second protruding members 252F and 252R on the LPH 14 side are supported by the XZ direction supporting members 123F and 123R respectively. Thereby, the positions in the X direction and the Z direction of the LPH 14 are set at the same time.

Figure 9:
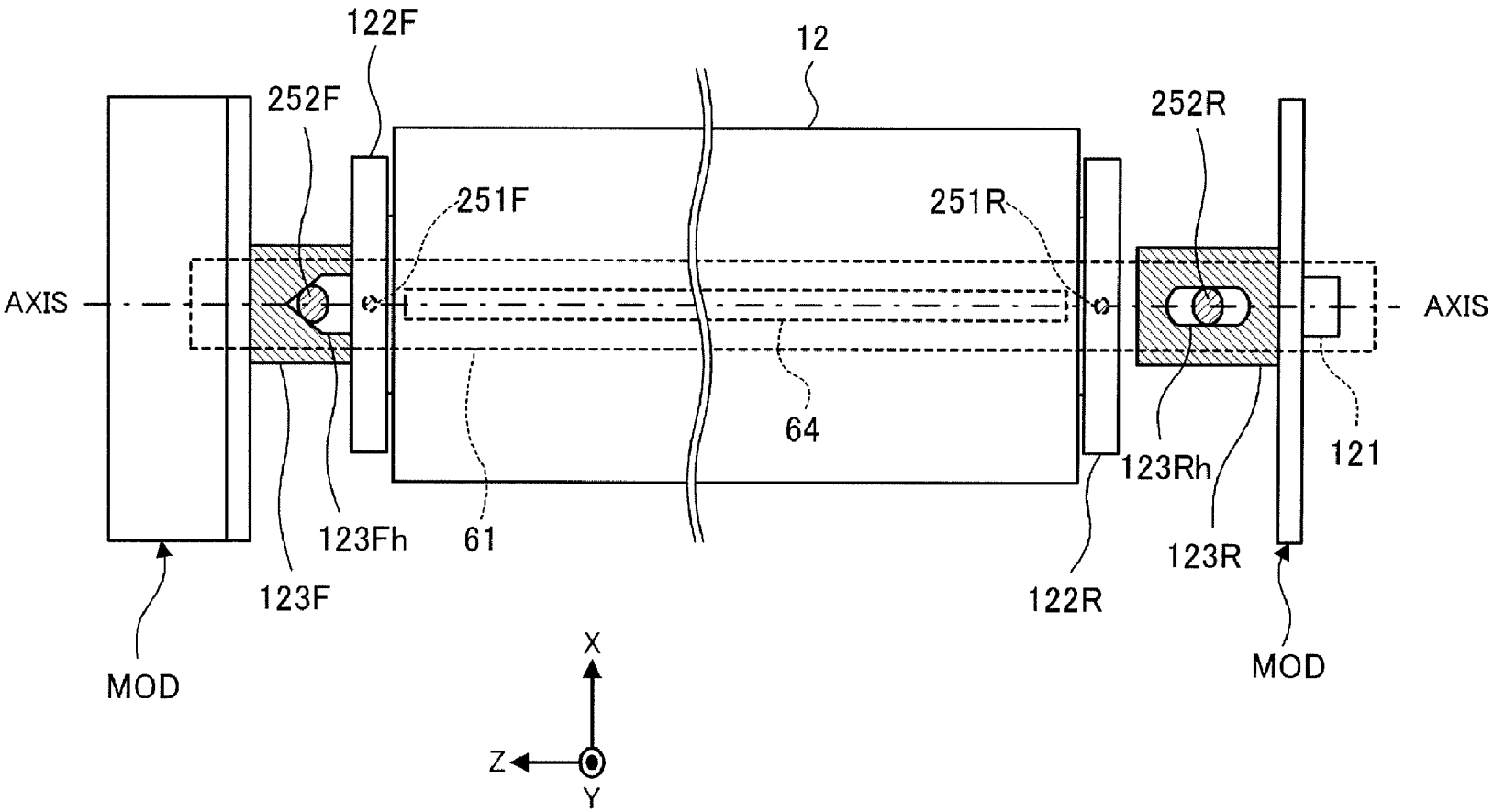
FIG. 9 is a view that shows positional relationships and sectional shapes of the photoconductor drum, the first protruding members, the Y direction supporting members, the second protruding members and the XZ direction supporting members in the state where the LPH is set at the exposure position.

FIG. 9 is a view that shows positional relationships and sectional shapes of the photoconductor drum 12, the first protruding members 251F and 251R, the Y direction supporting members 122F and 122R, the second protruding members 252F and 252R and the XZ direction supporting members 123F and 123R in the state where the LPH 14 is set at the exposure position.

As shown in FIG. 9, in the XZ direction supporting member 123F, on a XZ plane, a top position is set on the axis of the photoconductor drum 12, and a groove portion 123Fh that has a sectional shape of a V-like shape formed symmetrically to the axis in the X direction is formed. Since the groove portion 123Fh supports the second protruding member 252F, on the XZ plane, the center of the second protruding member 252F is set on the axis of the photoconductor drum 12. That is, the LPH 14 is biased in the direction from the rear side towards the XZ direction supporting member 123F side (Z direction) by a pushing spring 212 (refer to FIG. 7) that is provided in a main body frame FRA. Therefore, the second protruding member 252F is also biased to the XZ direction supporting member 123F side within the groove portion 123Fh of the XZ direction supporting member 123F. Consequently, since the second protruding member 252F is supported by a side surface of the V shape portion of the groove portion 123Fh at two points, a center position of the second protruding member 252F on the X plane is set so as to coincide with the axis position of the photoconductor drum 12.

Here, the "sectional shape of a V-like shape of the groove portion 123Fh" is a shape in which a distance on the XZ plane of two surfaces configuring the groove portion 123Fh is continuously narrowed towards the biasing direction of the pushing spring 212.

In the XZ direction supporting member 123R, there is formed a groove portion 123Rh that has a sectional shape of a rectangle-like shape with both end portions thereof configured by curves. The groove portion 123Rh is formed with width in the X direction approximately coinciding with an outer diameter of the second protruding member 252R (that is, a sum of manufacturing tolerance and the above outer diameter), and also formed symmetrically to the axis in the X direction. Therefore, by inserting the second protruding member 252R into the groove portion 123Rh, on the XZ plane, the center of the second protruding member 252R is set on the axis of the photoconductor drum 12. That is, while a position in the X direction of the second protruding member 252R is fixed by the groove portion 123Rh, a center position of the second protruding member 252R on the XZ plane is set so as to coincide with the axis position of the photoconductor drum 12.

As mentioned above, the center positions of the second protruding member 252F and the second protruding member 252R on the XZ plane are set on the axis of the photoconductor drum 12.

By supporting the second protruding member 252F by the side portion of the V shape portion of the groove portion 123Fh of the XZ direction supporting member 123F at two points while the side portion being in close contact with the second protruding member 252 F at two points, at a position in the Z direction that is determined at an installed position of the groove portion 123Fh of the XZ direction supporting member 123F, a position in the Z direction of the LPH 14 is set with high accuracy.

Further, the position in the X direction of the second protruding member 252R is fixed by the groove portion 123Rh, and the second protruding member 252F is biased by the pushing spring 212 towards the groove portion 123Fh of the XZ direction supporting member 123F, that is, in the Z direction. Therefore, the positions in the X direction and Z direction of the LPH 14 are fixed.

Meanwhile, the position in the Y direction of the LPH 14 is set by striking the Y direction supporting members 122F and 122R by the first protruding members 251F and 251R on the LPH 14 side respectively.

In the image forming apparatus 1 according to the first exemplary embodiment, in addition to the positioning mechanism of the LPH 14 mentioned above, a contact-retracting mechanism (retracting mechanism) of the LPH 14 is provided.

That is, as shown in FIG. 7, as the retracting mechanism that moves the LPH 14 to a position where the LPH 14 is retracted from the photoconductor drum 12, a cam 260 with one end thereof rotatably supported by the housing 61 of the LPH 14 and the other end thereof rotatably supported by a retracting member 220, a pushup spring 211 that biases the housing 61 of the LPH 14 upward, the retracting member 220 that slides in the lateral direction so as to change an inclination angle of the cam 260, a stage 221 that guides the sliding movement of the retracting member 220, a retracting handle 225 that slides the retracting member 220, a guide member 240 that guides movement of the LPH 14 in the up and down direction, and a stopper 230 that limits movement of the LPH 14 in the front side direction are provided.

An up and down movement member 270 is integrally attached to the cam 260. The up and down movement member 270 is configured so as to move in the up and down direction in accordance with the inclination angle of the cam 260. As shown in FIG. 7, in the state where the LPH 14 is set at the exposure position, the up and down movement member 270 is set at a position on the lower side. As shown in FIG. 8, in the state where the LPH 14 is set at the LPH retracted position, the up and down movement member 270 is set at a position on the upper side. By such movement in the up and down direction of the up and down movement member 270, the rotation action with regard to the developing unit 15 mentioned above is performed taking the position Q as the rotational center. It should be noted that a detailed description is given below to the rotation action of the developing unit 15 by the movement in the up and down direction of the up and down movement member 270.

In the retracting mechanism of the LPH 14, in the state where the LPH 14 is set at the exposure position as shown in FIG. 7, the retracting member 220 is set at a position on the left side in FIG. 7 by the retracting handle 225. Thereby, the inclination angle of the cam 260 to the retracting member 220 is set to approximately 90 degrees so as to push up the LPH 14 in the direction of the photoconductor drum 12. Corresponding to the inclination angle of the cam 260, the up and down movement member 270 that is integrally attached to the cam 260 is set at a position on the lower side.

Meanwhile, in the case where the LPH 14 is set at the LPH retracted position as shown in FIG. 8, by pulling down the retracting handle 225 to the left side in FIG. 8, the retracting member 220 that is supported by the stage 221 slides from the front side to the rear side (in the right side direction in FIG. 8). When the retracting member 220 slides from the front side to the rear side, a coupling portion of the cam 260 with the retracting member 220 is moved to the rear side and the cam 260 is inclined to the left side in FIG. 8. Thereby, the LPH 14 that is pushed up by the cam 260 is pushed down while resisting a bias force of the pushup spring 211. Thus, the LPH 14 is retracted from the photoconductor drum 12 downward.

At that time, the first protruding members 251F and 251R and the second protruding members 252F and 252R are detached from the Y direction supporting members 122F and 122R and the XZ direction supporting members 123F and 123R respectively. Linking with the inclination of the cam 260, the up and down movement member 270 that is integrally attached to the cam 260 is set at a position on the upper side.

Figure 10:
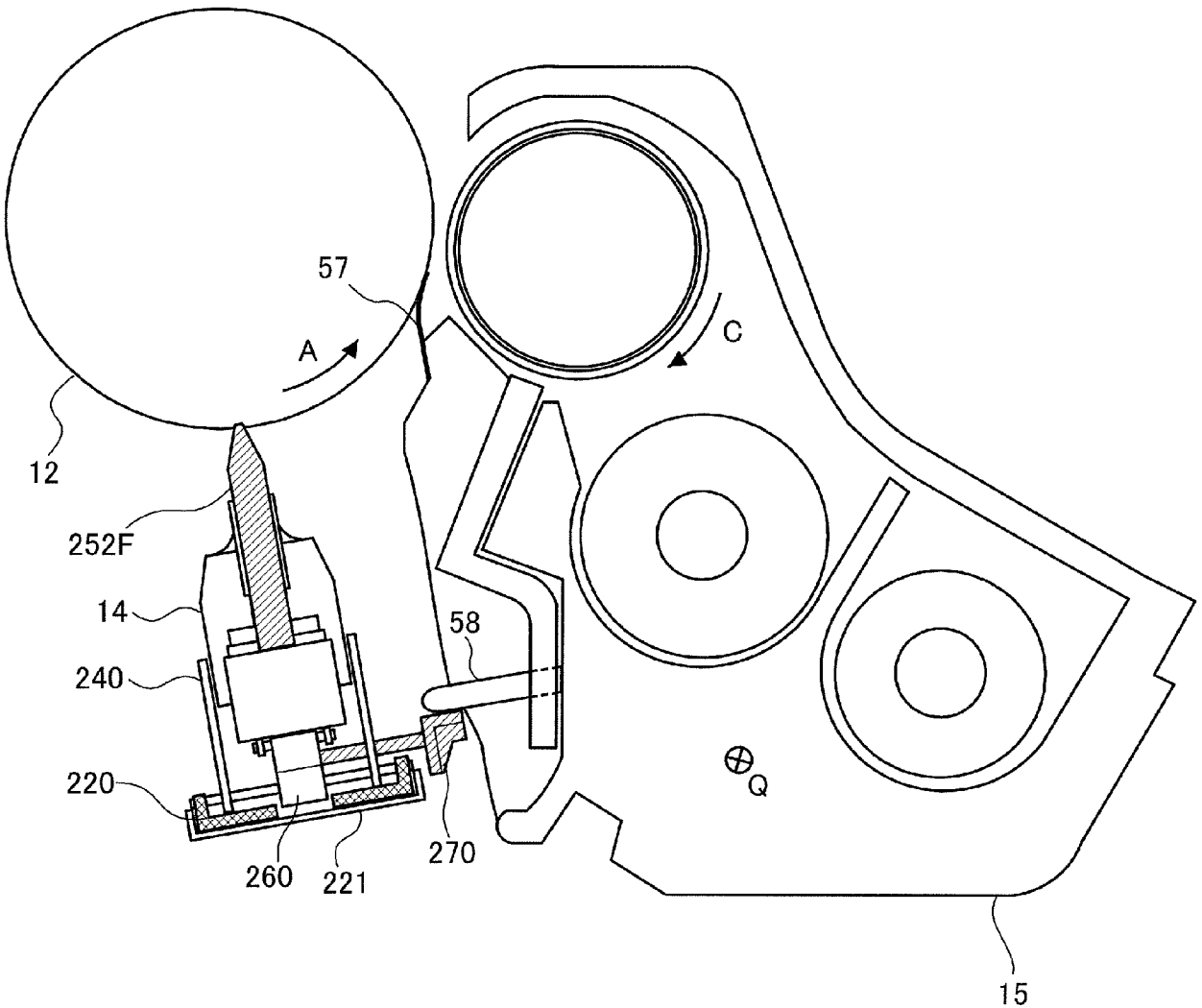
FIG. 10 is a view that shows a state where the developing unit is arranged at the developing position by setting the up and down movement member at a position on the lower side.
Figure 11:
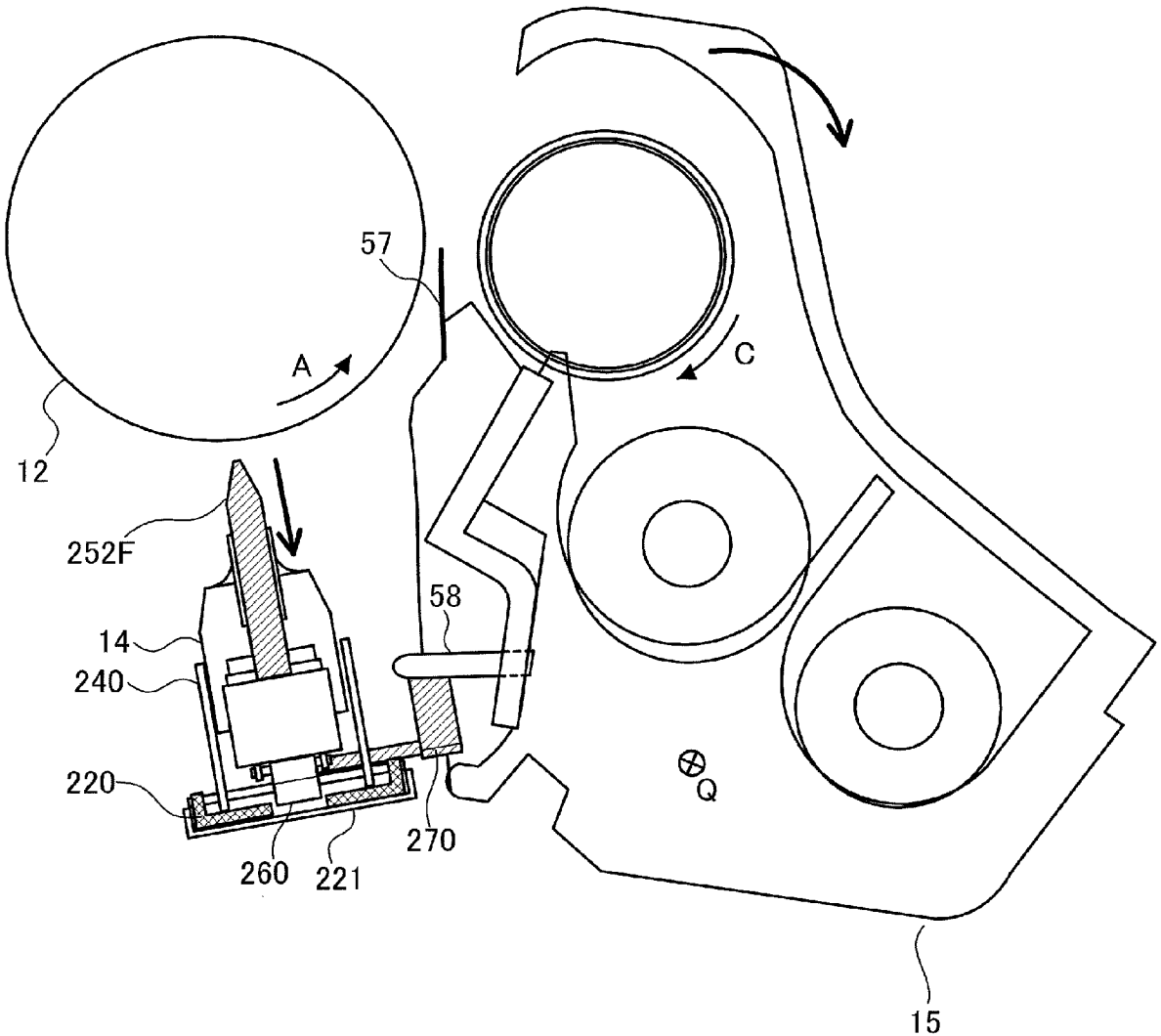
FIG. 11 is a view that shows a state where the developing unit is arranged at the developing unit retracted position by setting the up and down movement member at a position on the upper side.

Here, a description is given to the rotation action of the developing unit 15 by the up and down movement of the up and down movement member 270. FIG. 10 is a view that shows a state where the developing unit 15 is arranged at the developing position by setting the up and down movement member 270 at a position on the lower side. FIG. 11 is a view that shows a state where the developing unit 15 is arranged at the developing unit retracted position by setting the up and down movement member 270 at a position on the upper side.

The developing unit 15 is provided with a lever 58 serving as an example of a rotational movement member that is fixed integrally with the supporting container 51 at a position opposed to the up and down movement member 270 of the retracting mechanism of the LPH 14. As shown in FIG. 10, in the state where the LPH 14 is set at the exposure position (refer to FIG. 7), in the case where the cam 260 pushes up the LPH 14 in the direction of the photoconductor drum 12, the up and down movement member 270 is located on the lower side of the lever 58 with no force effected to the lever 58.

Meanwhile, as shown in FIG. 11, in the state where the LPH 14 is set at the LPH retracted position (refer to FIG. 8 as well), in the case where the cam 260 pushes down the LPH 14 in the direction away from the photoconductor drum 12, the up and down movement member 270 is pushed up with an upward force effected to the lever 58. Thereby, the lever 58 is brought up to the upper side, and the developing unit 15 is rotated taking the position Q as the rotational center and retracted from the photoconductor drum 12.

Figure 12A:
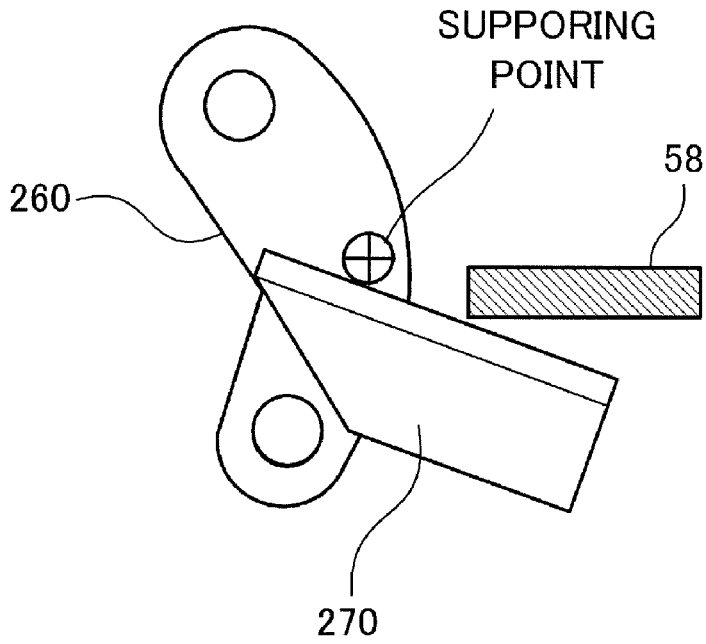
FIGS. 12A and 12B are views that show a state where the lever is brought up to the upper side by the up and down movement member.
Figure 12B:
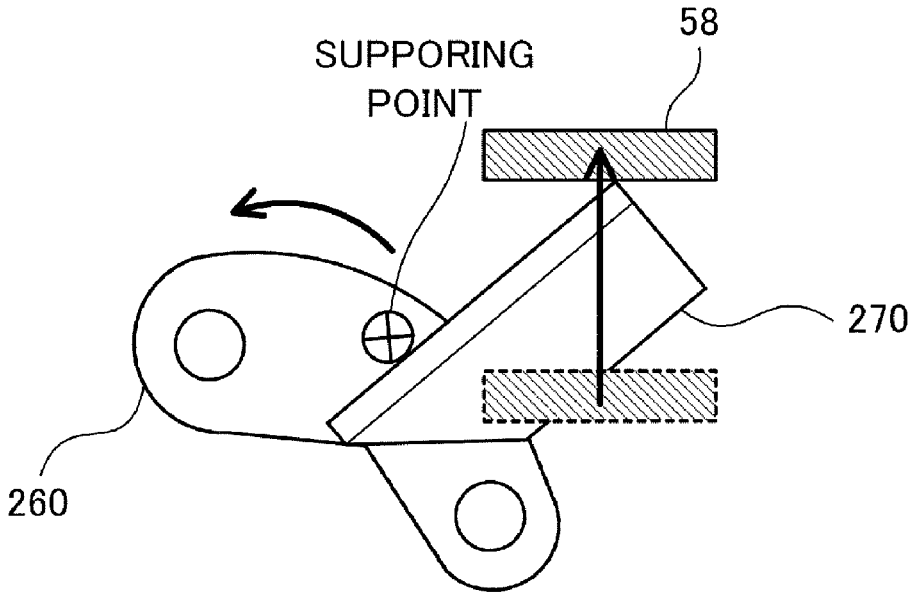

FIGS. 12A and 12B are views that show a state where the lever 58 is brought up to the upper side by the up and down movement member 270. FIG. 12A shows a state where the up and down movement member 270 is located on the lower side of the lever 58 with no force effected to the lever 58. FIG. 12B shows a state where the up and down movement member 270 brings up the lever 58 to the upper side with an upward force effected to the lever 58.

As shown in FIGS. 12A and 12B, linking with the inclination of the cam 260 taking a supporting point as a center, since the up and down movement member 270 brings up the lever 58 to the upper side, the developing unit 15 is rotated taking the position Q as the rotational center and retracted from the photoconductor drum 12.

As mentioned above, in the first exemplary embodiment, the up and down movement member 270 that is integrally attached to the cam 260, the lever 58 that is attached to the developing unit 15, and the retracting member 220 configures a contact-retracting unit as an example.

It should be noted that in order to set the LPH 14 at the exposure position again, the retracting handle 225 is pulled down to the right side in FIG. 8 and set so as to return to the original position shown in FIG. 7. Then, the retracting member 220 slides from the rear side to the front side (in the left side direction in FIG. 8). Thereby, the inclination angle of the cam 260 is approximately 90 degrees, and in accordance with the inclination angle, the LPH 14 is moved to the upper side and set at the exposure position again. In such a state, the position in the Y direction of the LPH 14 is fixed by the first protruding members 251F and 251R and the Y direction supporting members 122F and 122R. The positions in the X direction and Z direction of the LPH 14 are also fixed by the second protruding members 252F and 252R and the XZ direction supporting members 123F and 123R.

In accordance with the cam 260 coming up to the inclination angle of approximately 90 degrees, the up and down movement member 270 is moved to the lower side. Thereby, the lever 58 is moved to the lower side and the developing unit 15 is set at the developing position again.

It should be noted that, in the image forming apparatus 1 according to the first exemplary embodiment, although the LED printhead (LPH) 14 serving as an example of an exposure member is used, an exposure member with a method for scan and exposure with laser beam may be used.

In addition to the protruding unit 51*e* that is provided in the supporting container 51, on the lower side of the protruding unit 51*e*, a tray that, for example, in the case where the toner or the like that is put on the end portion of the sealing member 57 (the area on the end portion 57*b* side) spills down, collects the toner or the like may be provided.

As mentioned above, in the image forming apparatus 1 according to the first exemplary embodiment, in the developing unit 15, the contact-retracting action from the photoconductor drum 12 is performed by the rotation action taking, as the rotational center, the predetermined position Q that is on the lower side of the sealing member 57 and on the opposite side to the LPH 14 relative to the sealing member 57.

Thereby, the dropping-off of the toner and the carrier that are put on the sealing member 57 to the LPH 14 side is suppressed.

Second Exemplary Embodiment

In the first exemplary embodiment, the description is given to the case where following the retracting action of the LPH 14, the retracting action of the developing unit 15 is performed. In the second exemplary embodiment, a description is given to the case where the retracting action of the developing unit 15 is started, and linking with the retracting action, the retracting action of the LPH 14 is performed. It should be noted that the same reference numerals are used for a similar configuration to the first exemplary embodiment, and a detailed description thereof is omitted.

Figure 13:
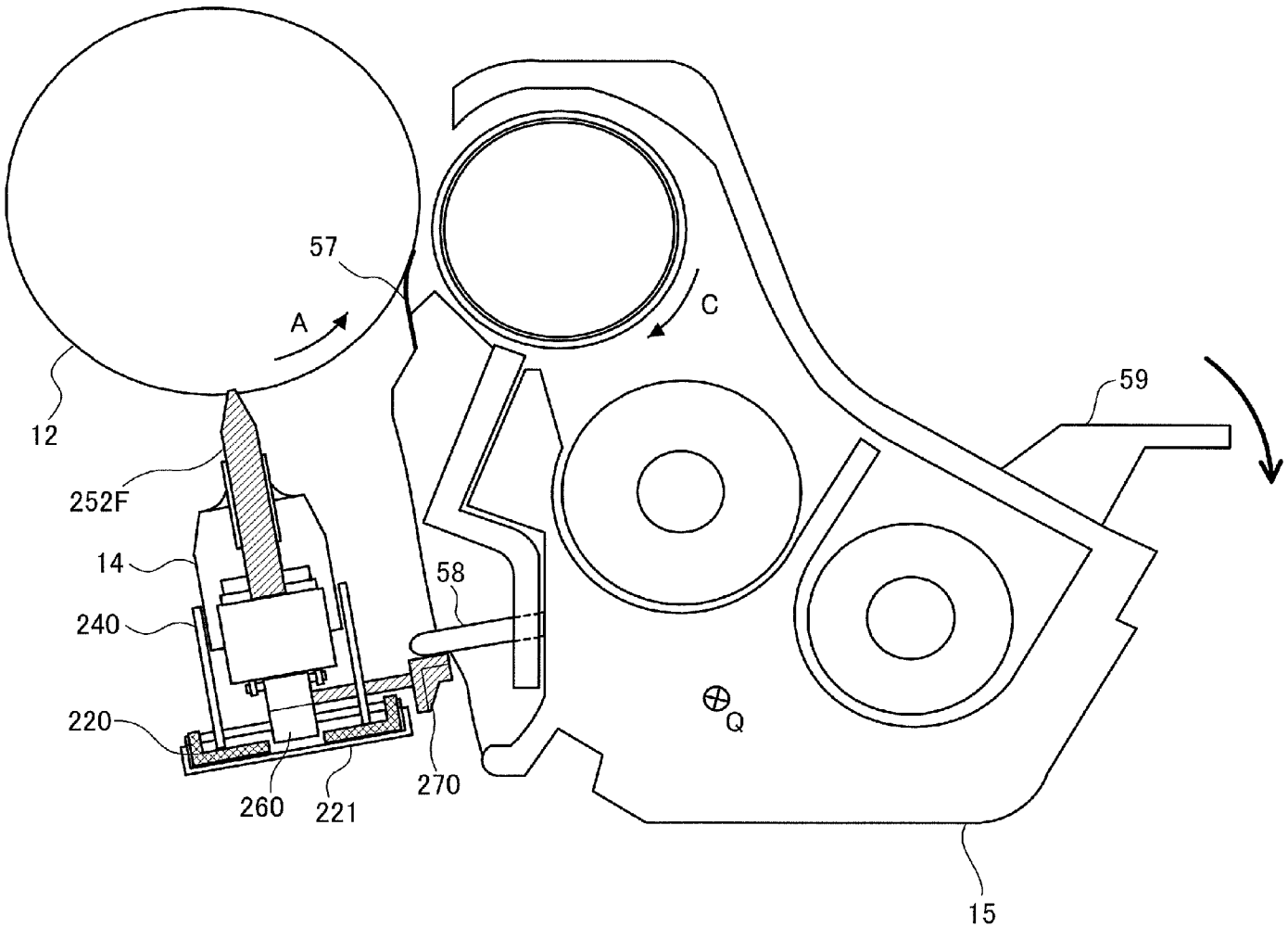
FIG. 13 is a view that shows a state where the developing unit is set at the developing position.

In the image forming apparatus 1 according to the second exemplary embodiment, as shown in FIG. 13 (a view that shows a state where the developing unit 15 is set at the developing position), the developing unit 15 is provided with a handle 59. In the developing unit 15, by pushing down the handle 59 by, for example, a user, the rotation action taking the above-mentioned position Q as the rotational center is performed. That is, in the state where the developing unit 15 is set at the developing position as shown in FIG. 13, by pushing down the handle 59 that is attached to the developing unit 15, the retracting action of the developing unit 15 is firstly performed. Linking with the retracting action of the developing unit 15, the retracting action of the LPH 14 is performed following the retracting action of the developing unit 15.

It should be noted that the retracting action of the developing unit 15 and the retracting action of the LPH 14 may be performed independently from each other.

Figure 14A:
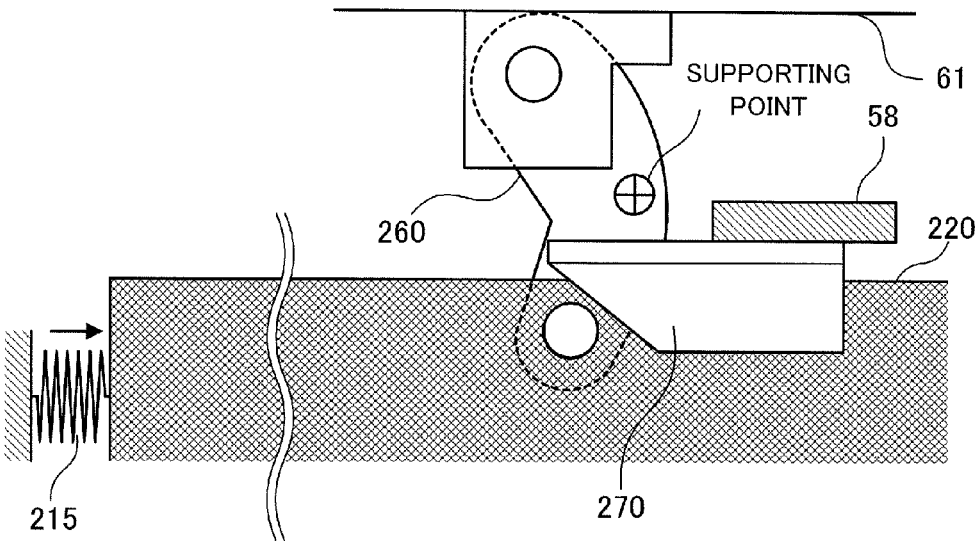
FIGS. 14A and 14B are views that explain the retracting mechanism of the LPH according to the second exemplary embodiment.
Figure 14B:
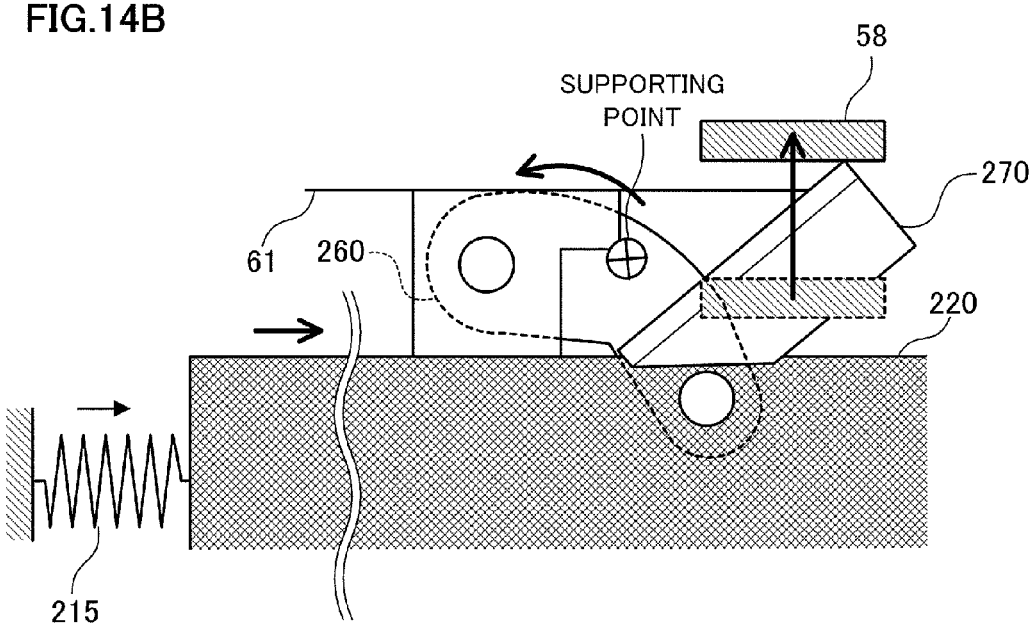

FIGS. 14A and 14B are views that explain the retracting mechanism of the LPH 14 according to the second exemplary embodiment. In the second exemplary embodiment, instead of the retracting handle 225 shown in FIGS. 7 and 8, a pressurizing spring member 215 that biases the retracting member 220 in the direction from the left side to the right side in FIG. 14 (the arrow direction in the figure) is provided.

As shown in FIG. 14A, in the state where the developing unit 15 is set at the developing position as shown in FIG. 13, the up and down movement member 270 of the retracting mechanism is set at a position on the lower side by the lever 58 as an example of the rotational movement member of the developing unit 15. By setting the up and down movement member 270 at a position on the lower side by the lever 58, the cam 260 comes up to the inclination angle of approximately 90 degrees. At this time, the retracting member 220 that is linked up to the cam 260 is located on the left side in FIG. 14 while resisting a bias force of the pressurizing spring member 215. That is, a state where the cam 260 comes up to the inclination angle of approximately 90 degrees is sustained while resisting the bias force of the pressurizing spring member 215 through the retracting member 220. Thereby, a state where the LPH 14 is pushed up in the direction of the photoconductor drum 12 is sustained.

Meanwhile, as shown in FIG. 14B, when the retracting action of the developing unit 15 is started by pushing down the handle 59 of the developing unit 15, the lever 58 is moved to the upper side (in the arrow direction in the figure). According to the movement of the lever 58 to the upper side, a force of pushing down the up and down movement member 270 by the lever 58 is gradually released. Then, the retracting member 220 is moved in the direction from the left side to the right side in FIG. 14 (in the arrow direction in the figure) by the bias force of the pressurizing spring member 215. Thereby, the cam 260 is inclined to the left side in FIG. 14, and the LPH 14 is pushed down. The LPH 14 is retracted from the photoconductor drum 12 downward.

In such a way, in the second exemplary embodiment, the up and down movement member 270 that is integrally attached to the cam 260, the lever 58 that is attached to the developing unit 15, the retracting member 220 and the pressurizing spring member 215 that biases the retracting member 220 configure a contact-retracting unit as an example.

As mentioned above, in the image forming apparatus 1 according to the second exemplary embodiment, by pushing down the handle 59 of the developing unit 15, the retracting action of the developing unit 15 is firstly started by the rotation action taking the position Q as the rotational center. Following the retracting action of the developing unit 15, the retracting action of the LPH 14 is performed. Thereby, the developing unit 15 is early retracted from the photoconductor drum 12. Even when the toner or the like spills down from the developing unit 15, the toner or the like is hardly put on the light emitting surface of the rod lens array 64 of the LPH 14.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

an exposure member that exposes the image carrier and forms an electrostatic latent image on the image carrier;

a developing member that develops the electrostatic latent image formed on the image carrier;

a contact-retracting unit that rotates the developing member taking a predetermined position as the rotational center, and brings the developing member in contact with or in proximity to the image carrier or retracts the developing member from the image carrier, the rotational center of the developing member being located within a housing of the developing member;

wherein the developing member is provided with a sealing member that is in contact with the image carrier in a state of deflection at the developing position of the developing unit;

wherein when the developing member rotated by the contact retracting unit is in the middle of moving to the developing unit retracted position, deflection generated in the sealing member is gradually released, and the sealing member is retracted from the image carrier from the upstream side in the rotational direction of the image carrier in order; and wherein the contact-retracting unit makes the rotation action of the developing member link with the action of bringing the exposure member in contact with or in proximity to the image carrier or retracting the exposure member from the image carrier.

2. The image forming apparatus according to claim 1, wherein the rotational center is located at a position below the sealing member, and the sealing member is disposed between the exposure member and the predetermined position.

3. The image forming apparatus according to claim 1, wherein the contact-retracting unit starts the rotation action of the developing member, and performs an action of bringing the exposure member in contact with or proximity to the image carrier or retracting the exposure member from the image carrier, after the start of the rotation action.

4. The image forming apparatus according to claim 1, wherein the contact-retracting unit rotates the developing member so that a moving amount in the horizontal direction of the sealing member is larger than a moving amount in the horizontal direction of the exposure member.

5. The image forming apparatus according to claim 1, wherein the contact-retracting unit starts the rotation action of the developing member before the action of bringing the exposure member in contact with or proximity to the image carrier or retracting the exposure member from the image carrier.

6. The image forming apparatus according to claim 1, wherein the contact-retracting unit moves the developing member in the horizontal direction after a moving amount of the developing member exceeds a predetermined amount during the rotation action of the developing member.

7. The image forming apparatus according to claim 1, wherein the developing member comprises a protruding unit that protrudes toward the image carrier, and is disposed below the sealing member.

8. A developing apparatus comprising:

a developer holding member that holds a developer;

a supporting container that supports the developer holding member; and a rotational movement member that is provided in the supporting container and rotationally moves the supporting container at a predetermined angle taking a predetermined position as the rotational center, the rotational center of the supporting container being located within a housing of the supporting container;

wherein the supporting container is provided with a sealing member that is in contact with an image carrier to which the developer holding member supplies the developer in a state of deflection at the developing position of the developing apparatus;

wherein when the developing apparatus rotated by the rotation action of the supporting container rotated by the rotational movement member is in the middle of moving to the developing unit retracted position, while deflection generated in the sealing member is gradually released, the sealing member is retracted from the image carrier from the upstream side in the rotational direction of the image carrier in order, and wherein the rotational movement member makes the rotation action of the supporting container link with the action of bringing an exposure member in contact with or in proximity to the image carrier or retracting the exposure member from the image carrier.

9. The developing apparatus according to claim 8, wherein the rotational center is located below the sealing member.

10. The developing apparatus according to claim 9, wherein the rotational center is located on the opposite side of the sealing member from an image carrier.

11. The developing apparatus according to claim 8, wherein the supporting container comprises a protruding unit that protrudes toward the image carrier, and is disposed below the sealing member.

* * * * *